United States Patent [19]

Lu

[11] 4,218,530

[45] Aug. 19, 1980

[54] SINGLE COMPONENT MAGNETIC TONER

[75] Inventor: Chin H. Lu, Webster, N.Y.

[73] Assignee: Xerox Corporation, Stamford, Conn.

[21] Appl. No.: 921,410

[22] Filed: Jul. 3, 1978

Related U.S. Application Data

[63] Continuation of Ser. No. 792,636, May 2, 1977, abandoned.

[51] Int. Cl.[2] ..... G03G 13/09

[52] U.S. Cl. ..... 430/107; 430/122

[58] Field of Search ..... 427/127, 215, 220, 221; 252/62.1 P; 96/1 SD; 430/107, 122

[56] References Cited

U.S. PATENT DOCUMENTS

| | | | |
|---|---|---|---|
| 3,922,381 | 11/1975 | Datta | 427/215 |
| 3,928,220 | 12/1975 | Slusarczuk | 427/127 |

*Primary Examiner*—Bernard D. Pianalto

*Attorney, Agent, or Firm*—J. J. Ralabate; R. A. Gerlach; E. O. Palazzo

[57] ABSTRACT

A toner and process of its manufacture for use in electrostatic development processes involving a magnetic toner without carrier are disclosed. The toner of the invention is semiconductive and effectively transferred from photoreceptors to plain paper after development. The preferred process of formation involves spray drying from a slurry solution.

29 Claims, 3 Drawing Figures

SINGLE COMPONENT MAGNETIC TONER

This is a continuation, of application Ser. No. 792,636, filed May 2, 1977 and now abandoned.

BACKGROUND OF THE INVENTION

This invention relates to electrophotographic development utilizing magnetic toner particles which are applied from magnetic brush to the electrostatic latent image without use of a carrier material.

A vast majority of the electrographic copying processes in use today involve creation on a suitable recording medium of an electrostatic charge pattern corresponding to a pattern of light and shadow to be reproduced and the development of that pattern by deposition of marking material on the recording medium according to forces generated by such electrical potential pattern. Xerography is the most widely known of these techniques. The substrate may be photoconductive, such as in the case of selenium as taught in Carlson's U.S. Pat. No. 2,297,691, or may be a conventional insulating substrate overlying a photoconductor layer, as described in Watanabe, U.S. Pat. No. 3,536,483, to name a few examples.

After creation the electrical potential pattern is generally developed by means of a finely divided developer powder thus giving form to the hitherto latent electrostatic image. In a common technique a fine, insulating, electroscopic powder is cascaded over the electrical potential pattern bearing member. The powder is, in the conventional use, triboelectrically charged to a definite polarity and deposits preferentially in regions of the surface where there is a preponderance of charge of the opposite polarity. The triboelectric charge is caused by presence of carrier beads in the powder mix. This technique of development is called cascade development.

In another form of cascade development, called magnetic brush development, magnetic carriers or magnetic toners are employed. In this technique a magnetic force is used to provide adherence of the toner-carrier mixture to a support member which is then presented to the image bearing member. In comparison to cascade development, magnetic brush development fills in solid areas better, is more compact, and does not depend on gravity to present the toner to the surface, a factor which allows freedom in locating the developer station.

In yet another form of electrostatic charge pattern development, a conductive one-component toner is used by bringing a conductive support member bearing a layer of fine conductive toner powder into contact with the charge pattern bearing member as in U.S. Pat. No. 3,166,432 to Gundlach. In this case the toner is held to the support member by van der Waal's forces and the conductive support member is held at a bias potential during development. This technique fills in solid areas and requires only one component in the developer material.

A further method of developing an electrostatic charge pattern is to employ an electroscopic toner suspended in a liquid. With the proper choice of materials, the toner becomes charged to a definite polarity when dispersed in the liquid. When the electrostatic charge pattern bearing member is brought into contact with the liquid suspension, the toners deposit where there is a preponderance of charge of the opposite polarity as in cascade development.

While all of the above techniques have certain advantages in particular situations, each one suffers from disadvantages which impair their utility in actual machines.

In the conventional cascade development technique the toner-carrier combination has a definite charge polarity and is not reversible without changing the toner or the carrier. Thus, positive and negative developed images cannot easily be made. Also the images are hollow and solid areas are not filled in resulting in low-fidelity development compared to the original charge pattern. The triboelectric properties of the toner, while necessary to development, cause severe problems. Uneven charging of the toners causes backgrounding as do the uneven forces between carrier and toner result in varying threshold levels from toner to toner. Also, since the toner retains its charge for long periods of time, during cascading some toners escape the development region and enter other parts of the apparatus causing mechanical problems. These problems, coupled with the inherent problems of using a two-component system where only one component is depleted, definitely limit the utility of such techniques.

The magnetic brush development, as it also uses carrier, suffers from some of the above mentioned disadvantages although it overcomes others. As mentioned above, this technique is less efficient but helps to fill in solid areas. However, it still requires triboelectric toners, which have the concomitant problems mentioned above. Also, due to the mechanical brushing action and other electrical characteristics, this technique usually results in high background deposition and poor machine latitude.

The process described in Gundlach, U.S. Pat. No. 3,166,432, has many advantages over the above mentioned cascade type techniques. However, it suffers from drawbacks which limit its applicability. The van der Waal's forces, which act to adhere the toner onto the conductive support member, are a counterforce to the image producing electric force generated by the electrostatic charge pattern, and as such must be selectively overcome to have toner deposited. The van der Waal's forces are weak and non-uniform from one toner to the next. Also high contrast is difficult to achieve. The fact that the van der Waal's forces are not under direct control but subject largely to the surface properties of the materials involved makes the system highly susceptible to alteration of development properties upon wearing of the involved surfaces or variations in ambient conditions of temperature and humidity.

In a liquid development technique most of the problems of cascade development are present in addition to other unique to a liquid system. The technique requires triboelectric charging, making image reversal difficult as explained above. Also, as in the case of cascade development, the charge on a given toner is not well controlled, resulting in high background deposition, poor machine latitude, and a characteristic splotchiness in large dark or grey areas. The inherent problems of the handling liquids, usually solvents, in a machine are also present.

There have been suggested systems for magnetic development not utilizing the carrier material. One such system was described in U.S. Pat. No. 2,846,333 to Wilson. Wilson et al disclosed the use of magnetic brush to apply toner particles formed of ferrites and resin material to develop electrostatic latent images. The difficulty with this process was the conductivity of the toner made electrostatic transfer difficult.

A further development of magnetic development without carriers is illustrated by Kotz, U.S. Pat. No. 3,909,258 wherein an electrostatic development process utilizing a magnetic brush without carrier is illustrated. A toner suitable for use in the Kotz process is disclosed in U.S. Pat. No. 3,639,245 to Nelson wherein a dry toner powder having specific electric conductivity is disclosed. The toner of Nelson is formed by blending magnetite with the resin and then after blending pulverizing to a small particle size. The particles are then mixed with conductive carbon black which is imbedded in the surface of the particle and then a small particle size $SiO_2$ agent is mixed into the toner to improve the flowability. The toner of Nelson suffers the disadvantage that it does not transfer well from a photoconductive substrate to plain bond paper.

Therefore there is a continuing need for toners suitable for use in one component magnetic development systems. There is a need for toners suitable for high speed development that also have good electrostatic transfer characteristics for transfer from a photoconductive surface to plain bond paper.

SUMMARY OF THE INVENTION

It is an object of this invention to provide a toner overcoming the above noted deficiencies.

It is a further object of this invention to provide a process of toner manufacture that overcomes the deficiencies of the above noted processes.

It is another object to produce clear sharp images by magnetic brush development of electrostatic images without using a carrier.

It is a further object to produce a toner that will transfer electrostatically from the photoreceptor to plain bond paper.

It is another additional object to form a toner suitable for high speed development by magnetic brush system without carrier.

It is a still further object to produce a toner whose electrical resistivity is field dependent.

It is still an additional object of this invention to form electrically field dependent toner by a simple process.

It is another object to form toners which after transferred to paper adhere sufficiently well by electrostatic forces that image disturbances (blur) do not occur on handling prior to fusing.

These and other objects of the invention are generally accomplished by formation of a toner comprising magnetically attractable material and a resin wherein the magnetically attractable particle is coated with a thin coating of material compatible with the resin of the toner but having a strong affinity for the magnetite surface and compatible with the solvents used in the toner formation. The toner of the invention is preferably formed by spray drying from a slurry solution.

In a specific embodiment in accordance with the instant invention a stearic acid is neutralized with ammonium hydroxide to form a water soluble ammonium compound. Magnetite pigment is added to the aqueous solution with agitation such that the ammonium compound is deposited on the pigment surface and then decomposed and converted back to the stearic acid by heating. The material is filtered, washed and dryed and the pigment is then dispersed in a solution of toluene and styrene-butylmethacrylate resin and spray dryed. The magnetite may be used in an amount of about 50 percent by weight of the resin magnetite dispersion. The solvent forms about two thirds by weight of the total spray drying slurry solution. Magnetite coated by other methods is also suitable for the instant process.

DESCRIPTION OF THE INVENTION

Figure 1:
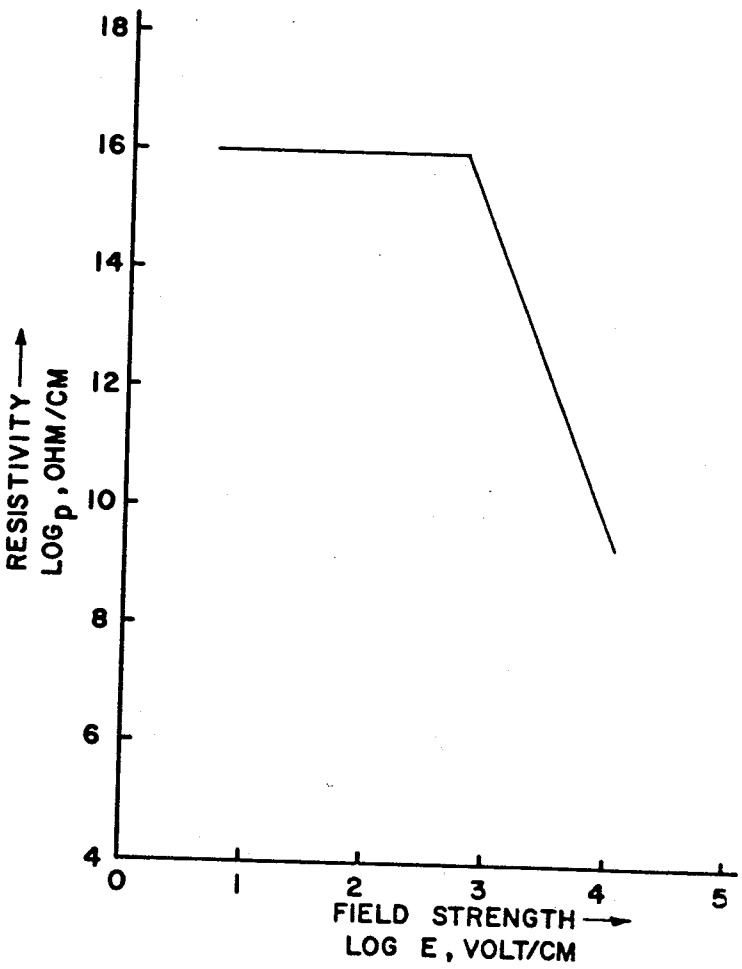
FIG. 1 illustrates the resistivity versus electrical field strength of a toner of the instant invention.

The toners of the instant invention generally have resistivity that is dependent on the strength of the electrical field. They are conductive during the high field during development but have a powder resistivity of about $10^7$ to $10^{17}$ ohm-cm at the low field during transfer. The great field dependent resistivity change of these toners allows transfer of the toner by the customary electrostatic transfer processes without use of specially treated paper or transfer techniques such as pressure or use of adhesives. Further the toner is conductive at high fields so as to easily develop by inductive techniques. The toners of the instant invention have a resistivity of greater than about $10^{12}$ ohm-cm at low fields of about 10 volt/cm which corresponds to about 1 log E volt/cm as used in the drawings. It is preferred that the high resistivity of greater than about $10^{12}$ ohm-cm be maintained at at least up to about 100 volt/cm field strength which corresponds to about 2 log E volt/cm in the drawings to give greater transfer latitude. The preferred initial resistivity is greater than $10^{14}$ ohm-cm which of course corresponds to about 14 log E ohm-cm on the drawings as this range allows good transfer of the electrostatic image. The toners of the invention display a substantially stable resistivity as field strength increases and then have a sharp break point where the resistivity rapidly decreases at a slope of greater than about 5 when plotted as the log of powder resistivity (ohm-cm) versus log of the field in volt/cm. The preferred slope is greater than about 10. Generally the slope is about 10 to 20 for toners of the invention. The slope greater than about 10 is preferred as it results in excellent electrostatic transfer and also good development.

The toners and magnetic pigments therein of the instant invention are referred to as magnetic because they are attracted to a magnet. They are not themselves magnets. The toners are held to a magnetic brush roller or belt by magnetic forces. The mag brush is biased to induce a charge, opposite to that carried by the photoreceptor, into the toner particles. Then the outer particles develop the electrostatic image as the electrostatic forces overcome the magnetic forces to deposit toner in the image areas. The earlier referenced U.S. Pat. No. 3,909,258 has illustrations of the forces present in the developing process utilizing a magnetic brush system without a carrier.

The magnetic pigment utilized in the toners of the invention may be any suitable particle which will give the desired magnetic properties. Typical of such materials are ferrites, iron particles and nickel alloys. Preferred for the instant process are magnetite particles as they are black in color, low cost and provide excellent magnetic properties. The magnetite particles may be of any shape and any size which results in a semiconductive toner particles with good transfer properties. Generally the particle size is between 0.02 micron and about 1 micron. A preferred average particle size for the magnetite particles is about 0.1 to 0.5 micron average particles size. The particles may be a acicular or cubic shaped.

The transfer efficiency of the toners of the instant invention is greater than about 70 percent and generally reaches 85 percent in ordinary electrostatic transfer.

The coated magnetic pigment may be utilized in any amount that forms a magnetic field dependent toner. A suitable range has been found to be a magnetic pigment content between about 40 and about 70 weight percent of coated magnetic particle in the finished toner. A preferred range is a coated magnetite content between about 45 and 55 weight percent of coated magnetite for good magnetic development properties and good transfer.

The material coating the magnetic particle may be any material which is compatible with the toner resin and maintains a firm bond to the magnetic particle during mixing with a solvent for the toner resin and spray drying. These materials generally are surfactants. The magnetic particle coating suitably has one moiety displaying affinity to the magnetite surface such as carboxylic, sulfate, sulfonate, phosphate, ester, alcohol, amine, amide groups and quarternary ammonium compounds, or combinations of the above and another moiety which displays affinity to the resin and the solvent such as long chain aliphatic groups comprising from 6 to 22 carbon atoms or aromatic groups of about the same carbon content. Preferred are stearic acid and stearic acid derivative materials which have been found to have good dispersion properties and result in desirable semiconductive toner properties that aid in transfer. The amount of coating typically may vary between about 0.1 and 10 percent by weight. A preferred range of coating material for magnetite is about 1 to about 5 weight percent of the magnetite for good insulative properties at low field.

The toner resins may be selected from any suitable toner resin material that is compatible with the coating of the magnetite.

While any suitable resin possessing the properties as above described may be employed in the system of the present invention. Typical of such resins are polyamides, polyurethanes, epoxy, vinyl resins and polymeric esterification products of a dicarboxylic acid and a diol comprising a diphenol. Any suitable vinyl resin may be employed in the toners of the present system including homopolymers or copolymers of two or more vinyl monomers. Typical of such vinyl monomeric units include: styrene; p-chlorostyrene; vinyl naphthalene; ethylencally unsaturated mono-olefins such as ethylene, propylene, butylene, isobutylene and the like; vinyl esters such as vinyl chloride, vinyl bromide, vinyl fluoride, vinyl acetate, vinyl propionate, vinyl benzoate, vinyl butyrate and the like; esters of alphamethylene aliphatic monocarboxylic acids such as methyl acrylate, ethyl acrylate, n-butylacrylate, isobutyl acrylate, dodecyl acrylate, n-octyl acrylate, 2-chloroethyl acrylate, phenyl acrylate, methyl-alphachloracrylate, methyl methacrylate, ethyl methacrylate, butyl methacrylate and the like; acrylonitrile, methacrylonitrile, acrylamide, vinyl ethers such as vinyl methyl ether, vinyl isobutyl ether, vinyl ethyl ether, and the like; vinyl ketones such as vinyl methyl ketone, vinyl hexyl ketone, methyl isopropenyl ketone and the like; vinylidene halides such as vinylidene chloride, vinylidene chlorofluoride and the like; and N-vinyl compounds such as N-vinyl pyrrol, N-vinyl carbozole, N-vinyl indole, N-vinyl pyrrolidene and the like; and mixtures thereof.

It is generally found that toner resins containing a relatively high percentage of styrene are preferred since greater image definition and density is obtained with their use. The styrene resin employed may be a homopolymer of styrene or styrene homologs or copolymers of styrene with other monomeric groups containing a single methylene group attached to a carbon atom by a double bond. Any of the above typical monomeric units may be copolymerized with styrene by addition polymerization. Styrene resins may also be formed by the polymerization of mixtures of two or more unsaturated monomeric materials with a styrene monomer. The addition polymerization technique employed embraces known polymerization technique such as free radical, anionic and cationic polymerization processes. Any of these vinyl resins may be blended with one or more other resins if desired, preferably other vinyl resins which insure good triboelectric properties and uniform resistance against physical degradation. However, non-vinyl type thermoplastic resins may also be employed including resin modified phenolformaldehyde resins, oil modified epoxy resins, polyurethane resins, cellulosic resins, polyether resins and mixtures thereof.

Polymeric esterification products of a dicarboxylic acid and a diol comprising a diphenol may also be used as a preferred resin material for the toner compositions of the instant invention. The diphenol reactant has the general formula:

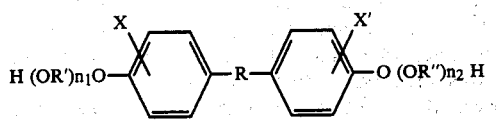

wherein R represents substituted and unsubstituted alkylene radicals having from 2 to 12 carbon atoms, alkylidene radicals having from 1 to 12 carbon atoms and cycloalkylidene radicals having from 3 to 12 carbon atoms; R' and R'' represent substituted and unsubstituted alkylene radicals having from 2 to 12 carbon atoms, alkylene arylene radicals having from 8 to 12 carbon atoms and arylene radicals; X and X' represents hydrogen or an alkyl radical having from 1 to 4 carbon atoms; and $n_1$ and $n_2$ are each at least 1 and the average sum of $n_1$ and $n_2$ is less than 21. Diphenols wherein R represents an alkylene radical having from 2 to 4 carbon atoms and R' and R'' represents an alkylene radical having from 3 to 4 carbon atoms are preferred because greater blocking resistance, increased definition of xerographic characters and more complete transfer of toner images are achieved. Optimum results are obtained with diols in which R' is an isopropylidene radical and R' and R'' are selected from the group consisting of propylene and butylene radicals because the resins formed from these diols possess higher agglomeration resistance and penetrate extremely rapidly into paper receiving sheets under fusing conditions. Dicarboxylic acids having from 3 to 5 carbon atoms are preferred because the resulting toner resin possesses greater resistance to film formation on reusable imaging surfaces and resist the formation of fines under machine operation conditions. Preferred results are obtained with alpha unsaturated dicarboxylic acids including fumaric acid, maleic acid or maleic acid anhydride because maximum resistance to physical degradation of the toner as well as rapid melting properties are achieved. Any suitable diphenol which satisfies the above formula may be employed. Typical such diphenols include: 2,2-bis (4-beta hydroxy ethoxy phenyl)-propane, 2,2-bis(4-hydroxy isopropoxy phenyl) propane, 2,2-bis(4-beta hydroxy ethoxy phenyl) pentane, 2,2-bis(4-beta hydroxy ethoxy phenyl)-butane, 2,2-bis(4-hydroxy-propoxy-phenyl)-propane, 2,2-bis(4-hydroxy-propoxy-phenyl) propane, 1,1-bis(4-hydroxy-ethoxy-phenyl)-butane, 1,1-bis(4-hydroxy isopropoxy-phenyl) heptane, 2,2-bis(3-methyl-4-beta-hydroxy ethoxy-phenyl) propane, 1,1-bis(4-beta hydroxy ethoxy phenyl)-cyclohexane, 2,2'-bis(4-beta hydroxy ethoxy phenyl)-norbornane, 2,2'-bis(4-beta hydroxy ethoxy phenyl)norbornane, 2,2-bis(4-beta hydroxy styryl oxyphenyl) propane, the polyoxyethylene ether of isopropylidene diphenol in which both phenolic hydroxyl groups are oxyethylated and the average number of oxyethylene groups per mole is 2.6, the polyoxypropylene ether of 2-butylidene diphenol in which both the phenolic hydroxy groups are oxyalkylated and the average number of oxypropylene groups per mole is 2.5, and the like. Diphenols wherein R represents an alkylidene radical having from 3 to 4 carbon atoms are preferred because greater blocking resistance, increased definition of xerographic characters and more complete transfer of toner images are achieved. Optimum results are obtained with diols in which R is isopropylidene and R' and R'' are selected from the group consisting of propylene and butylene because the resins formed from these diols possess higher agglomeration resistance and penetrate extremely rapidly into paper receiving sheets under fusing conditions.

Any suitable dicarboxylic acid may be reacted with a diol as described above to form the toner compositions of this invention either substituted or unsubstituted, saturated or unsaturated, having the general formula:

$$HOOC\ R'''_{n3}COOH$$

wherein R'''represents a substituted or unsubstituted alkylene radical having from 1 to 12 carbon atoms, arylene radicals or alkylene arylene radicals having from 10 to 12 carbon atoms and $n_3$ is less than 2. Typical such dicarboxylic acids including their existing anhydrides are: oxalic acid, malonic acid, succinic acid, glutaric acid, adipic acid, pimelic acid, suberic acid, azelaic acid, sebacic acid, phthalic acid, mesaconic acid, homophthalic acid, isophthalic acid, terephthalic acid, o-phenyleneacetic-beta-propionic acid, itaconic acid, maleic acid, maleic acid anhydride, fumaric acid, phthalic acid anhydride, traumatic acid, citraconic acid, and the like. Dicarboxylic acids having from 3 to 5 carbon atoms are preferred because the resulting toner resins possess greater resistance to film formation on reusable imaging surfaces and resist formation of fines under machine operation conditions. Optimum results are obtained with alpha unsaturated dicarboxylic acids including fumaric acid, maleic acid, or maleic acid anhydride because maximum resistance to physical degradation of the toner as well as rapid melting properties are achieved. The polymerization esterification products may themselves be copolymerized or blended with one or more other thermoplastic resins, preferably aromatic resisns, aliphatic resisns, or mixtures thereof. Typical thermoplastic resins include: resins modified phenol-formaldehyde resin, oil modified epoxy resins, polyurethane resins, cellulosic resins, vinyl type resins and mixtures thereof. When the resin component of the toner contains an added resin, the added component should be present in an amount less than about 50 percent by weight based on the total weight of the resin present in the toner. A relatively high percentage of the polymeric diol and dicarboxylic acid condensation product in the resinous component of the tone is preferred because a greater reduction of fusing temperatures is achieved with a given quantity of additive material. Further, sharper images and denser images are obtained when a high percentage of the polymeric diol and dicarboxylic acid condensation product is present in the toner. Any suitable blending technique may be employed to incorporate the added resin into the toner mixture. The resulting resin blend is substantially homogeneous and highly compatible with pigments and dyes. Where suitable, the colorant may be added prior to, simultaneously with or subsequent to the blending or polymerization step.

Optimum electrophotographic results are achieved with styrene-butyl methacrylate copolymers, styrene-vinyltoluene copolymers, styrene-acrylate copolymers, polystyrene resins, predominately styrene or polystyrene based resins as generally described in U.S. Reissue 25,136 to Carlson and polystyrene blends as described in U.S. Pat. No. 2,788,288 to Rheinfrank and Jones.

Any method of toner particle formation may be utilized in the instant invention which results in toner of the desired properties. Typical of such methods are hot melt formation and mastication followed by attrition to toner particle size. The preferred method of the instant invention is forming a solvent dispersion of the magnetite and toner resin and spray drying the dispersion as this results in toner particles having the magnetite concentrated at the surface and results in toner of good magnetic and electrostatic properties for excellent magnetic induction development and electrostatic transfer to plain paper. While not wishing to be bound by any theory as to why the instant toners display their remarkable field dependent properties it is believed that the properties are somehow related to the concentration of magnetic particles at the surface of the toner and that the coating of the magnetic pigment contributes to this higher concentration that results after spray drying.

The solvent used for spray drying may be any material capable of dissolving the toner resin without adversely effecting the coating of the magnetite. Solvents for toner resins are well known including hydrocarbons, alcohols, ketones, esters, amides, fluorinated hydrocarbons, chlorinated hydrocarbons and other well known solvents. Preferred solvents are toluene for use with styrene polymer and styrene polymer blends as this results in a toner that is solvent free and the solvent is low cost and relatively non-toxic. Chloroform has been found to be a preferred solvent for use with polyester type toner resins as it is readily available, non-flammable and results in a toner of low residual solvent. Both chloroform and toluene also are compatible with the preferred fatty acid and derivative coatings for the magnetite. The solvent is generally used in an amount such that the solids content of the solvent slurry is 5–20% by weight. The term solids content is used here to indicate the solid resulting from spray drying which is the resin and magnetite plus any other additives to the toner such as colorants.

An invention relating to the formation of magnetite coated in a manner particularly suitable for use in the instant invention have been perfected and is fully disclosed and claimed in the concurrently filed application Titled: Pigment Coating Process. Magnetite coated by the inventive process is not humidity sensitive which is an advantage in toner formation and further readily is dispersed in solvents and resins without effecting the properties of the coating. This process is generally performed by neutralizing a fatty acid of stearic or a derivative of a fatty acid of a stearic acid with ammonium hydroxide to form a water soluble ammonium compound. The pigment preferably magnetite, is then added to the aqueous solution with agitation. Ammonium compound is deposited on the pigment surface and then decomposed and converted back to the fatty acid or derivative of a fatty acid by heating. The aqueous dispersion is then filtered, washed and dryed. The pigment coated by this process is hydrophobic and has good dispersion properties in organic matrixes such as polymer resins and organic solvents. Among suitable fatty acids and fatty acid derivatives are myristic, pentadecanoic, palmitic, lavric, margaric, oleic, and linoleic acids and mixtures thereof. Preferred are stearic acids and mixtures of stearic acid and other fatty acids of $C_{14}$ to $C_{18}$ to give good coating and electrical properties.

An invention relating to another method of forming the toners of the invention is disclosed and claimed in concurrently filed application entitled: In Situ Coating Then Spray Drying of Magnetic Toner. This toner forming method involves generally spray drying a dispersion of resin and magnetite coated with a fatty acid or derivative of a fatty acid to form a toner. This dispersion of magnetite and fatty acid in solvent generally is agitated or heated with reflux and agitation for a time prior to addition of polymer and spray drying.

In a specific embodiment fifty parts by weight magnetite, 2 parts by weight stearic acid and 50 parts of toluene were mixed and heated to about 110° C. for about 1 hour with reflux and agitation. After heating the mixture is blended with a polymer solution containing a styrene polymer in toluene. The dispersion was then spray dryed to form a toner. The toner is found to have a powder resistivity from $10^6$ ohm-cm to $10^{17}$ ohm-cm depending on field strength.

The agitation or agitation with heating of the magnetite and fatty acid or fatty acid derivative in solvent may be carried out for any length of time resulting in a toner having the desired field dependent properties after spray drying. Generally the heating is carried out with reflux for a period of about 30 minutes to 3 hours. A preferred time of heating is about 1 hour with reflux which results in a toner having the desired field dependence without an overly long formation time period. A temperature of reflux heating is selected dependent on the volatility of the solvent being used. The heating temperature of about 100 to about 150° C. has been found to be typical for common solvents.

Other methods of coating the stearic acid or stearic acid derivatives onto magnetite particles may also be utilized. Among these processes are the direct coating onto magnetite particles by tumbling with a fatty acid material possibly with low heat. Another method of coating magnetite is to coat it with an ammonium stearate or other fatty acid ammonium salt and then heat the coated particle so that the fatty acid coating particle is recovered.

While the above discussion has not included the addition of additives to the solvent prior to spray drying for inclusion in the toner it is encompassed in the invention that additives such as pigments, humidity control materials and dyes may be added prior to toner formation. The preferred magnetite materials are black and therefore suitable for the majority of electrophotographic reproduction uses without benefit of colorant additives. However other less dark colored magnetic materials might require pigment or dye additives to obtain a suitable toner color. Such pigments and dyes are not needed to obtain the field sensitivity required of the invention.

It is further contemplated that after treatment processes such as classification might be necessary depending on the particle size range achieved by the spray drying.

DESCRIPTION OF THE PREFERRED EMBODIMENTS

The following Examples further define, describe and compare methods of preparing toners of the instant invention and of utilizing them in electrophotographic applications. Parts and percentages are by weight unless otherwise indicated.

EXAMPLE I 100 grams of 65/35 styrene-butylmethacrylate resin is dissolved in 500 grams toluene. After dissolving the resin with toluene 100 grams Pfizer MO 4431 coated magnetite is added to a Kady mill containing the solution and is milled for 30 minutes. The Pfizer coated magnetite comprises acicular particles of about 0.1 to about 1 micron length and 0.02 to 0.2 micron diameter. They are coated with stearate coating comprising a mixture of fatty acids and calcium salts. The calcium salts are believed to be hydrophilic resulting in a slightly humidity sensitive property. After milling the dispersion is fed to a Bowen spray dryer at a feed rate of 200 milliliters per minute and at a temperature of 180–220° F. Toner particles having an average size of about 15 microns and a range of from about 5 to about 30 microns are recovered. These toners are found to be capable of rapid development by using a magnetic system without carrier and are successfully transferred by electrostatic transfer at about a 75 percent transfer efficiency at low humidity. However, the toner is somewhat moisture sensitive and has a slope of about five at high humidity of 86%. The field resistivity of this toner is shown in FIG. 1 at 17% relative humidity.

EXAMPLE II

The process of Example I is repeated except 96 grams of Piccolastic D-125 a polystyrene polymer is substituted for the polymer and 104 grams of coated magnetite is utilized. The toner displays excellent transfer properties. The properties are similar to the Example I toner except it is more humidity sensitive.

EXAMPLE III

The process of Example I is repeated except that chloroform is substituted for the toluene and 100 grams of the polyester resin is substituted for the resin of Example I. This toner also exhibits good electrical characteristics and transfers very well. The properties are similar to the Example I toner.

EXAMPLE IV

The process of Example I is repeated except 120 grams of the coated magnetite are utilized and 80 grams of the resin. The toner of this Example also displays excellent transfer properties and good development characteristics. The properties are similar to the Example I toner.

EXAMPLE V

The process of Example I is again repeated except 130 grams of the coated magnetite is utilized and 70 grams of the resin. This toner also exhibits good transfer and development characteristics. The properties are similar to the Example I toner.

EXAMPLE VI

As a control, toner of Example A in U.S. Pat. No. 3,639,245 is fabricated. When utilized in electrostatic transfer apparatus this toner does not transfer effectively as only about 30 percent of the toner is transferred.

EXAMPLE VII

The process of Example I is repeated except 96 grams of Piccolastics D-125 a polystyrene polymer is substituted for the polymer and 104 grams of Cities Service Mapico Black magnetite coated with stearic acid is substituted for the magnetite. The Mapico Black magnetite comprises cubic particles of about 0.02 to about 0.8 micron. The toner displays excellent development and transfer characteristics.

EXAMPLE VIII

The above example is repeated except 70 grams of resin and 130 grams of coated magnetite are utilized. The toner also has excellent development and transfer properties.

EXAMPLE IX

Figure 2:
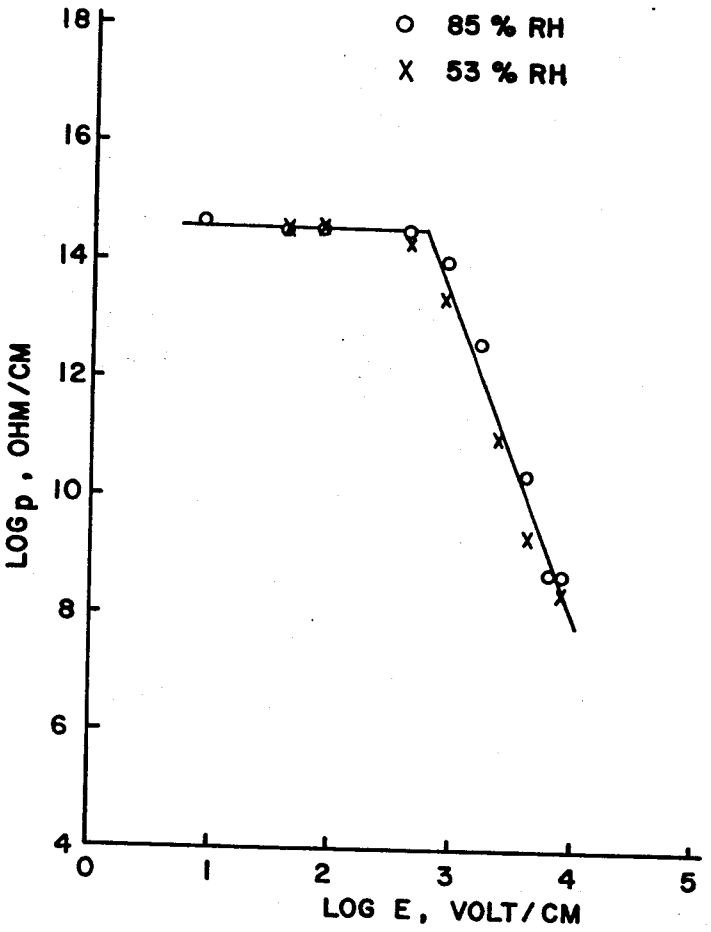
FIG. 2 illustrates the resistivity versus electrical field strength of a non-humidity sensitive toner of the instant invention.

A dispersion of about 100 grams Pfizer magnetite MO-4232, an uncoated magnetite, about 4 grams stearic acid and about 100 grams of toluene are mixed and heated to about 100° C. for 1 hour wth reflux and gentle agitation. This heating was carried out in a three neck flask. After heating, the mixture is blended with a polymer solution containing about 96 grams of polystyrene resin (Piccolastic D-125) in about 1000 grams of toluene. The dispersion is then spray dryed to a toner of about 12$\mu$ average particle size. The resulting toner had excellent field dependent characteristics. As illustrated by FIG. 2 the initial resistivity was greater than 14 ohm-cm initially and at a certain point dropped rapidly in resistivity. This toner also as illustrated by FIG. 2 showed very little humidity sensitivity. The toner was found to be capable of rapid development using a magnetic system without carrier and successfully transferred by electrostatic transfer at about a 75% rate of transfer efficiency.

EXAMPLE X

A toner is prepared as in Example IX except that about 98 grams of a 35/65 styrene and butylmethacrylate resin are substituted for the polystyrene resin of Example I. This toner is found to produce excellent transfer and have particularly desirable field dependent properties.

Figure 3:
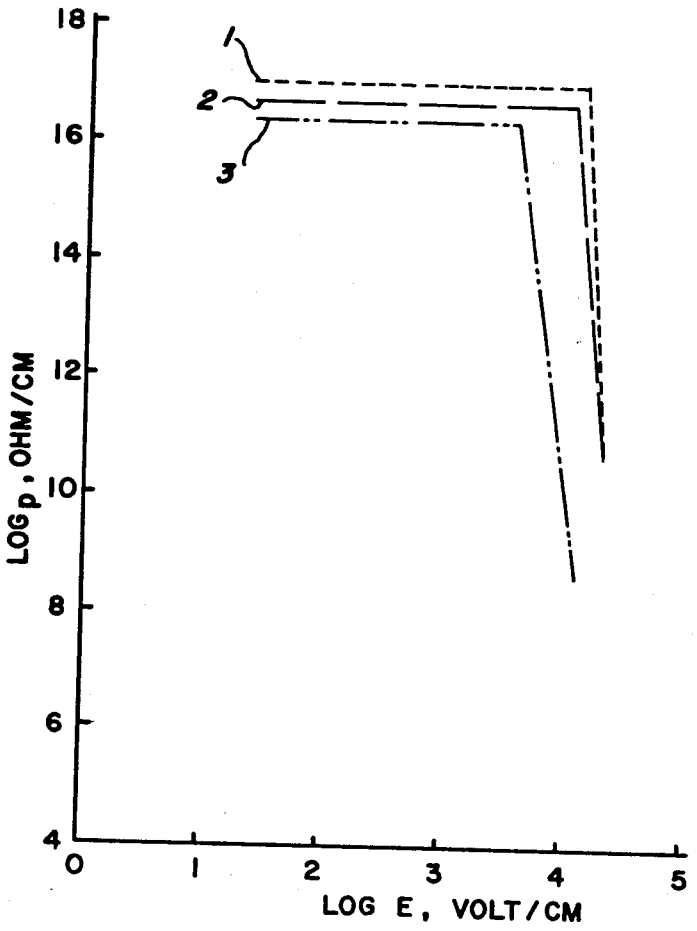
FIG. 3 illustrates the effect of varying the amount of magnetite coating of toners of the invention.

Resistivity of this toner is given as line 2 of FIG. 3.

EXAMPLE XI

The process of Example I is repeated except that about 2 grams of stearic acid are utilized and about 98 parts of the 65/35 styrene and butylmethacrylate of Example V. This toner also is found to produce desirable field dependent properties. The resistivity of this toner is shown by line 1 of FIG. 3 in the drawings.

EXAMPLE XII

The process of Example I is repeated except that about 6 grams of stearic acid are utilized and about 94 grams of a 65/35 styrene and butylmethacrylate resin of Example V. This toner also has desirable resistivity properties and is illustrated by line 3 of drawing FIG. 3.

EXAMPLE XIII

As a control, a toner was formed by spray drying a slurry of about 104 grams magnetite MO-4232 and 48% Piccolastic D-125 and about 400 grams toluene and when tested over the same range as illustrated in FIG. 2 the toner only varies between about $10^{16}$ and $10^{17}$ ohm-cm. The toners of the invention in contrast vary between about $10^{14}$ ohm-cm at a low field strength of about 40 volts and a resistivity of about $10^{8}$ ohm-cm at a field strength of about 8000 volts/cm.

The resistivity measurements for toner used throughout this application are determined by the following process. Measurements on powder are complicated by the fact that the results are influenced by characteristics of the powder particles shape and size in addition to powder composition. Therefore, measurements were obtained on powder rather than by molding the powder into a pellet specimen in order to better relate the properties to the toner behavior in development. The measurements were made using a two inch diameter electrode of a Balsbaugh cell for measuring the direct current resistivity of the toner. The gap distance is 0.05 inch . The toner is packed between the electrodes of the cell by vibration until a constant bed volume is reached. The current is measured as a function of applied voltage at the 50 mil gap. The electrification time is 1 minute as recommended by ASTM method. After each measurement the sample is repacked by vibration. Resistivity is calculated according to Ohms law and the data as presented in the figures is as a Log of resistivity verses Log of field strength.

The transfer efficiency in this application is measured comparing the weight of toner transferred to a paper with the weight of toner remaining on the photoreceptor and removed by an adhesive tape applied thereto after transfer to paper is completed.

Although specific materials and conditions were set forth in the above exemplary processes in the formation and using the toner of the invention these merely intended as illustrations of the present invention. Various other substituents and processes such as those listed above may be substituted for those in the examples with similar results. In addition to the steps used by the toner of the present invention other steps or modifications may be used. For instance the toner could be classified prior to utilization for developing and transfer. In addition other materials such as colorants could be added.

Other modifications of the present invention will occur to those skilled in the art upon reading the present disclosure. These are intended to be included within the scope of this invention. For instance, the magnetic toner of this invention could be utilized in conventional magnetic development onto zinc oxide paper where transfer did not take place. Further the toner of this invention could be utilized for processes requiring development of magnetic images rather than electrostatic latent images.

What is claimed is:

1. A single component, electrically field dependent developer comprising toner particles, said particles comprising a resin and magnetic particles coated with a surfactant, the surfactant being present in an amount of about 0.1 to about 10 weight percent of the magnetic material, said magnetic material being present at higher concentration near the toner particle surface than in the interior of particle the toner is characterized by a field dependence such that at low fields of less than 100 volt/cm the resistivity is greater than $10^{12}$ ohm-cm, and less than $10^{12}$ ohm-cm at fields greater than 100 volt-cm, some higher field they exhibit along a line of a slope greater than 5 when log of powder resistivity is plotted versus the log of the field in volt-cm.

2. The developer of claim 1 wherein said magnetic particles comprises magnetite.

3. The developer of claim 2 wherein said magnetite is present in an amount of from about 40 to about 70 weight percent of the toner.

4. The developer of claim 2 wherein said surfactant is present in an amount of between about 1 and about 3 percent by weight of the magnetite.

5. The developer of claim 1 wherein said toner has a powder resistivity of greater than $10^{12}$ ohm-cm at low fields.

6. The developer of claim 1 wherein said toner has a powder resistivity of less than $10^{8}$ ohm-cm at high fields.

7. The developer of claim 1 wherein said surfactant comprises one moiety, displaying affinity to the magnetic particle, consisting of carboxylic groups, sulfate groups, sulfonate groups, phosphate groups, ester groups, alcohol groups, amine groups, amide groups, quanternary ammonium compounds or combinations thereof and a second moiety, displaying affinity to the resin and solvent, consisting of long chain aliphatic groups comprising about 6 to 22 carbon atoms or aromatic groups of about the same carbon content.

8. The developer of claim 1 wherein said coated magnetic particles comprise magnetite surrounded by a coating of stearic acid derivatives.

9. The developer of claim 8 wherein said stearic acid derivatives comprise a mixture of fatty acids and calcium salts.

10. The single component developer of claim 1 wherein the magnetic particles have an average particle size between 0.02 micron and about 1 micron.

11. A single component electrically field dependent developer comprising toner particles, said particles comprising resin, and a surfactant coated magnetite wherein the surfactant coating comprises a fatty acid or fatty acid derivative and the toner is characterized by a field dependence such that at low fields of less than 100 volt/cm the resistivity is greater than $10^{12}$ ohm-cm and at some higher field they exhibit a sharp drop to a resistivity of less than $10^{8}$ ohm-cm along a line of a slope greater than 5 when log of powder resistivity is plotted versus the log of the field in volt/cm.

12. The developer of claim 11 wherein the resistivity is less than $10^{12}$ ohm-cm at fields of greater than 100 volt/cm.

13. The developer of claim 11 wherein the said slope is greater than 10.

14. The developer of claim 11 wherein said slope is between about 10 and about 20.

15. The developer of claim 11 wherein the resistivity at fields less than 100 volt/cm is greater than $10^{14}$ ohm-cm.

16. The developer of claim 11 wherein said fatty acid is selected from the group consisting of stearic acid, palmitic acid, lauric acid, myristic acid, pentadecanic acid, margaric acid, oleic acid, linoleic acid, and mixtures and derivatives thereof.

17. The developer of claim 11 wherein said magnetite is present in an amount of from about 40 to about 70 weight percent of the toner.

18. The developer of claim 11 wherein said surfactant coating is present in an amount of about 0.1 to about 10 weight percent of said magnetic material.

19. The developer of claim 11 wherein said coating surfactant is present in an amount of between about 1 and about 5 percent by weight of the magnetite.

20. A method of imaging comprising forming an electrostatic image, developing said electrostatic image with a single component electrically field dependent developer comprising toner particles said toner particles comprising resin and magnetic pigment, coated with a surfactant, the surfactant being present in an amount of about 0.1 to about 10 weight percent of the magnetic material, said developing being conducted at a field strength such that the toner particles have a resistivity of less than $10^{12}$ ohm-cm and electrostatically transferring the thus developed toner image to plain paper at a field strength less than 100 volt/cm at which the toner particles have a resistivity greater than $10^{12}$ ohm-cm.

21. The method of claim 20 wherein said magnetic pigment is magnetite coated with a surfactant comprising a fatty acid or a fatty acid derivative.

22. The method of claim 21 wherein the fatty acid is selected from the group consisting of stearic acid, palmitic acid, myristic acid, pentadecanic acid, margaric acid, oleic acid, linoleic acid, and mixtures and derivatives thereof.

23. The method of claim 21 wherein said fatty acid material comprises between 6 and 22 carbon atoms.

24. The method of claim 21 wherein said magnetite is present in an amount of from about 40 to about 70 weight percent of the toner.

25. The method of claim 21 wherein said surfactant coating is present in an amount of about 0.1 to about 10 weight percent of said magnetic material.

26. The method of claim 21 wherein said coating surfactant is present in an amount of between about 1 and about 5 percent by weight of the magnetite.

27. The method of claim 21 wherein the fatty acid material is present in an amount between about 2 and about 3 weight percent of the magnetite particle.

28. The method of claim 20 wherein the resistivity at fields less than 100 volt/cm is greater than $10^{14}$ ohm-cm.

29. A single component, electrically field dependent developer comprising toner particles said particles including resin and magnetic pigment coated with a surfactant, the surfactant being present in an amount of about 0.1 to about 10 weight percent of the magnetic material said toner exhibiting a substantially constant resistivity greater than $10^{12}$ ohm-cm as the field strength increases to a point where the resistivity decreases at a slope greater than about 5 to a resistivity less than about $10^{8}$ ohm-cm when log of powder resistivity in ohm-cm is plotted against field strength expressed as log E volt/cm.

* * * * *